United States Patent [19]

Ford et al.

[11] Patent Number: 4,935,988

[45] Date of Patent: Jun. 26, 1990

[54] CURTAIN ROD ASSEMBLY

[75] Inventors: James A. Ford; Alan A. Ford, both of Sturgis, Mich.

[73] Assignee: Cooper Industries, Houston, Tex.

[21] Appl. No.: 372,187

[22] Filed: Jun. 26, 1989

[51] Int. Cl.[5] ..... A47H 13/00

[52] U.S. Cl. ..... 16/87.4 R; 160/38; 160/345; 160/168.1; 160/900

[58] Field of Search ..... 16/87 R, 87.4 R; 160/38, 39, 168.1, 345, 900

[56] References Cited

U.S. PATENT DOCUMENTS

| | | | |
|---|---|---|---|
| 2,281,659 | 5/1942 | Balthasar | 16/87.4 R |
| 3,881,218 | 5/1975 | Palmer | 16/87.4 R |
| 4,079,770 | 3/1978 | Woodle | 160/39 |
| 4,518,025 | 5/1985 | Judkins | 160/168.1 |
| 4,662,421 | 5/1987 | Basmadji | 160/39 |
| 4,782,554 | 11/1988 | Lawson | 16/87.4 R |

FOREIGN PATENT DOCUMENTS

| | | | |
|---|---|---|---|
| 766934 | 9/1967 | Canada | 16/87 R |
| 934289 | 9/1973 | Canada | 160/38 |
| 192564 | 10/1957 | Fed. Rep. of Germany | 160/38 |

*Primary Examiner*—Richard K. Seidel
*Assistant Examiner*—Carmine Cuda
*Attorney, Agent, or Firm*—Kenyon & Kenyon

[57] ABSTRACT

An improved curtain rod assembly is disclosed which includes a track having a decorative fascia attached thereto. The track and fascia cooperate to permit the fascia to be easily attached thereto. A return plate is configured for attachment to the track and cooperates with a bracket assembly to support the track from a wall the appropriate distance. A side fascia is configured for attachment with the return plate and an elbow connects the fascia on the track and the return plate to provide an esthetically pleasing system.

16 Claims, 5 Drawing Sheets

FIG. 9
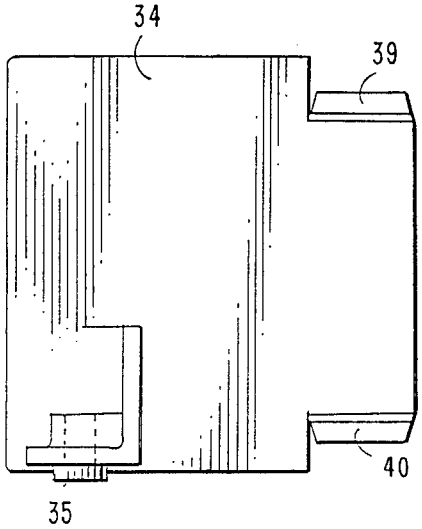
FIG. 11
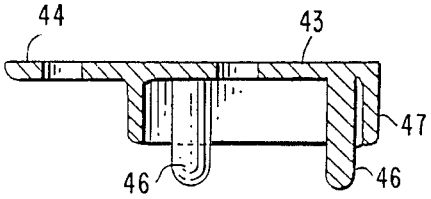
FIG. 12
FIG. 10
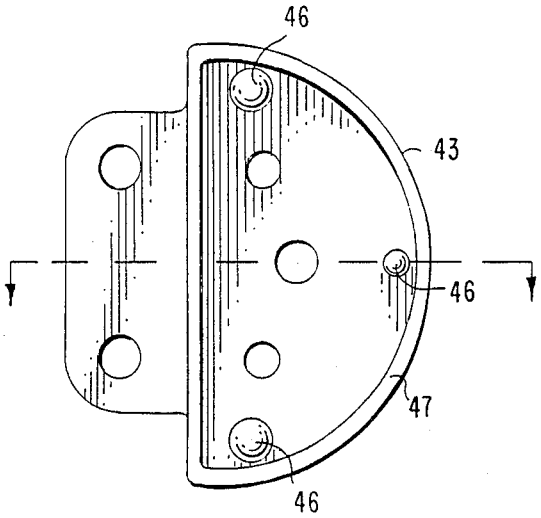
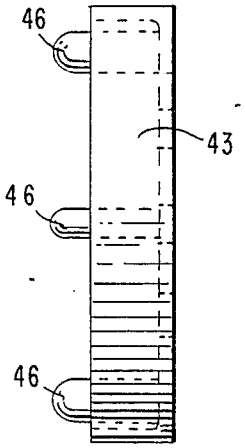

CURTAIN ROD ASSEMBLY

This application is a continuation of application Ser. No. 279,743, filed Dec. 5, 1988, now abandoned.

BACKGROUND AND DISCUSSION OF THE INVENTION

The present invention relates to curtain rods, especially those used in connection with vertical blinds and hand drawn curtains, as well as other curtain means.

Contemporary curtain rod assemblies are functional in that they enable the curtains or blinds hanging thereon to be supported in a window and permit the curtains or blinds to be drawn open or closed. However, such curtain rods generally are not aesthetically pleasing.

Attempts to improve the esthetic appeal of curtain rods have been only marginally successful. Generally, such curtain rods are expensive and their assembly is extremely time consuming. Others sacrifice functionality for aesthetic appeal.

It would be useful to be able to provide a curtain rod assembly exhibiting the characteristics of ease of assembly, aesthetic appeal, while maintaining full functionality.

The invention described herein overcomes the problems noted above by providing a functional system with aesthetic appeal. According to the present invention, a curtain rod includes a track on which curtains or other curtain means, such as vertical blinds, are supported. The track includes a fastener means for slidably receiving or clipping thereto a fascia member, which imparts aesthetic appeal to the curtain rod assembly. The unique assembly further includes elbow members and side fascia members to complement the aesthetic appeal of the assembly. The fascia members, which are slidably removable from the track, may be provided in a variety of colors or geometric shapes, enabling the user to change the color or style of the curtain assembly as required for example when differently colored or differently styled curtains are used.

The above has been a brief description of certain problems in the prior art and advantages of the invention. Other features will be apparent from the Detailed Description of the Preferred Embodiment which follows.

BRIEF DESCRIPTION OF THE DRAWINGS

FIG. 9 illustrates a rear view of the return means illustrated in FIG. 7.

FIG. 10 illustrates a front view of a socket means used with a preferred embodiment of the present invention.

FIG. 11 illustrates a sectional view taken along line AA of FIG. 10.

FIG. 12 illustrates a side view of the socket means illustrated in FIG. 10.

DETAILED DESCRIPTION OF THE INVENTION

Figure 1:
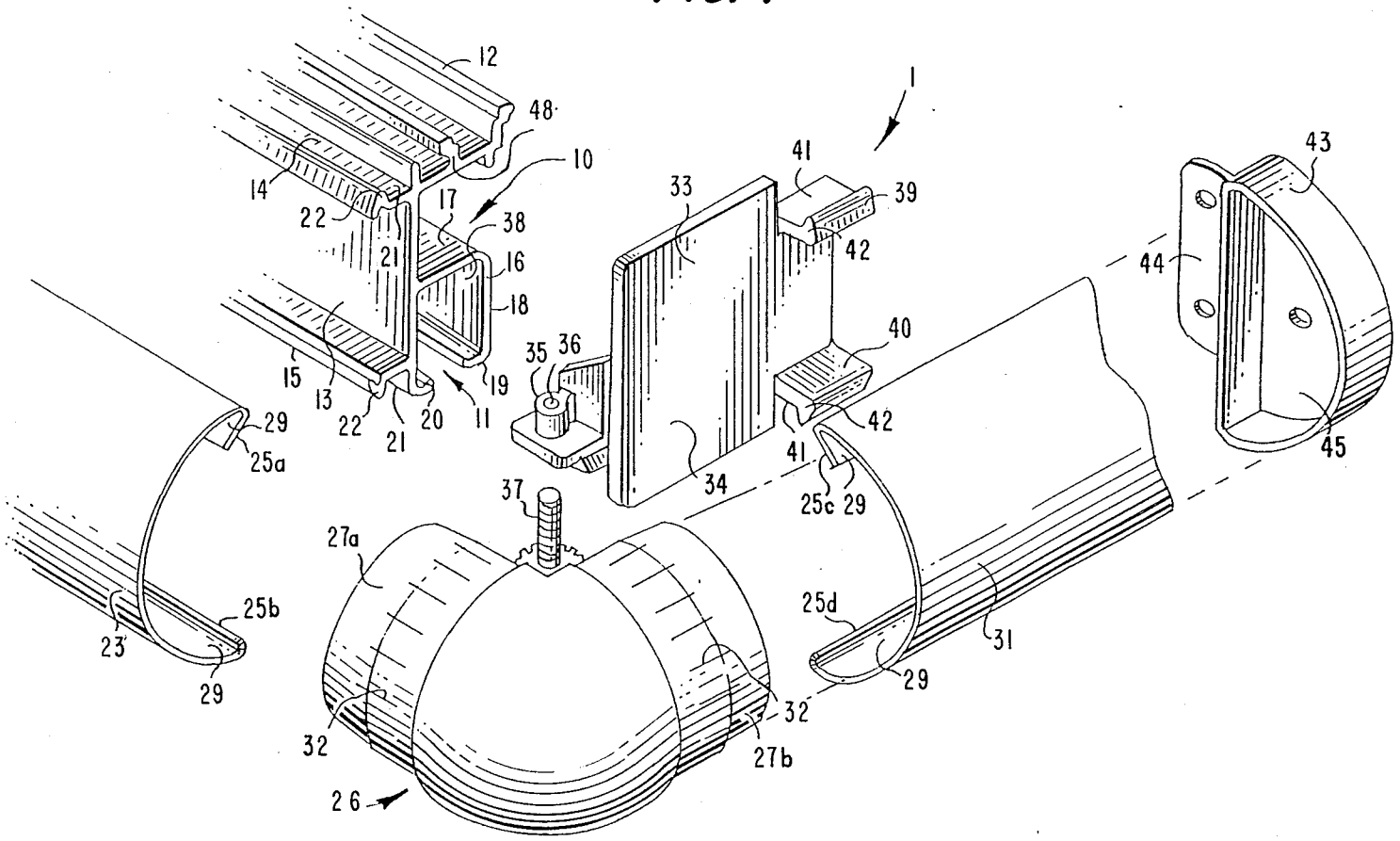
FIG. 1 illustrates an isometric exploded view of a preferred embodiment of the present invention.

As illustrated in FIG. 1, a curtain rod assembly 1, includes a track 10, which may be, for example a hand traverse cirmosa with baton draw, or a vertical blind fascia track. The track 10 is preferably fabricated of extruded aluminum, or other extrudable material, and, as illustrated in FIG. 1, is a hand traverse cirmosa with baton draw. The track 10 has a slotted section 11 for receiving rollers, such as those disclosed in U.S. Pat. No. 3,076,222, or other means for hanging curtains on the track.

The track 10 preferably includes a ribbed header portion 12, which provides strength and assists the track 10 in resisting deformation when loaded. A vertical wall member 13 on track 10 extends vertically from slotted section 11, and doubles as the front wall therefore, to ribbed header portion 12. The remainder of slotted section 11 is defined by an angled section 16 extending rearwardly from the vertical wall member 13 and having a top portion 17, and a rear portion 18. A rear lip 19 and front lip 20 are also defined by slotted section 11. Rollers (not shown) for hanging curtains are supported by the rear and front lips 19 and 20 and travel along the slotted section 11.

The vertical wall member 13 preferably further includes an upper flange 14 and a lower flange 15 extending outwardly from the vertical wall member 13 as indicated. The upper and lower flanges 14 and 15 each preferably include a grooved portion 21 bounded on the outward edge of the flanges 14 and 15 by a curbed portion 22.

Figure 2:
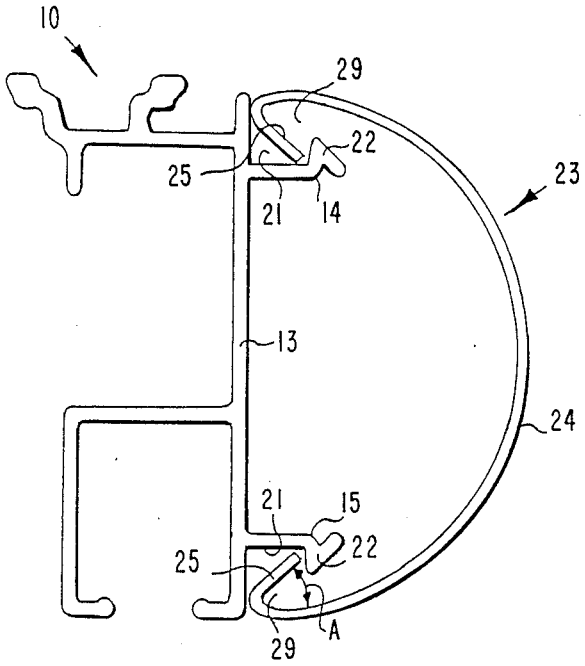
FIG. 2 illustrates a side view of a track member and fascia member of a preferred embodiment of the present invention.
Figure 3:
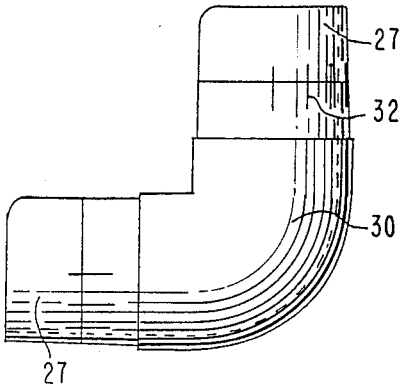
FIG. 3 illustrates a plan view of an elbow means for use with a preferred embodiment of the present invention.

The present invention further includes a fascia member 23 a preferred embodiment of which, as more clearly illustrated in FIG. 2, comprises a semicircular external wall section 24 and two inwardly extending (upper and lower) clip portions 25. Clip portions 25 of fascia 23 form an acute angle "A" of 39° 24′ with the semicircular external wall section 24, although other angles are acceptable. Additionally, wall section 24 need not be semicircular, as other geometric shapes could be used.

The clip portions 25 are designed such that the fascia 23 is slidably received by or clipped to track 10. Specifically, the clip portions 25 travel in the grooved portions 21 of the track 10 as illustrated, the upper clip portion 25*a* traveling in the grooved portion 21 of the upper flange 14, and the lower clip portion 25*b* traveling in the grooved portion 21 of the lower flange 15. The curved portions 22 retain the clip portions 25 of the fascia 23 in slidable engagement with track 10.

The fascia 23 is preferably fabricated of a durable, yet decorative material, such as rolled steel or high strength plastic. In a preferred embodiment of the invention, the fascia is fabricated of rolled steel which is coated with a colored decorative reflective coating. The fascia 23 is primarily a decorative component of the invention, serving to cover the less attractive track 10. However, the fascia 23 does impart a degree of deflection resistance to the overall curtain rod structure.

Figure 4:
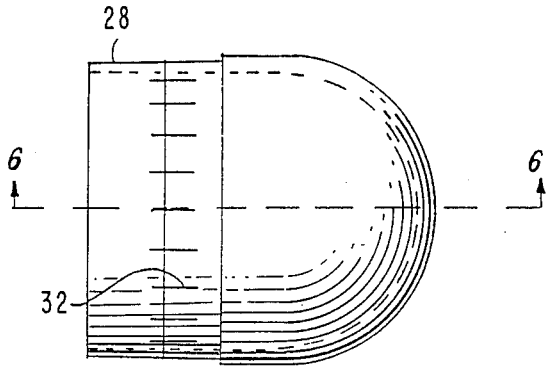
FIG. 4 illustrates a side view of the elbow means of FIG. 3.
Figure 5:
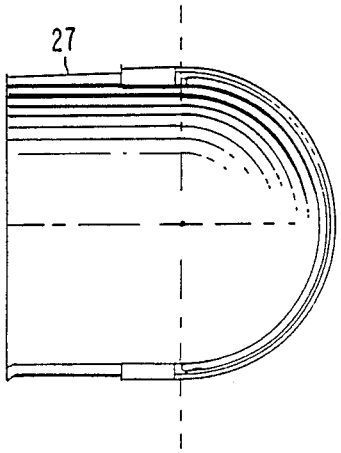
FIG. 5 illustrates another side view of the elbow means illustrated in FIG. 3.
Figure 6:
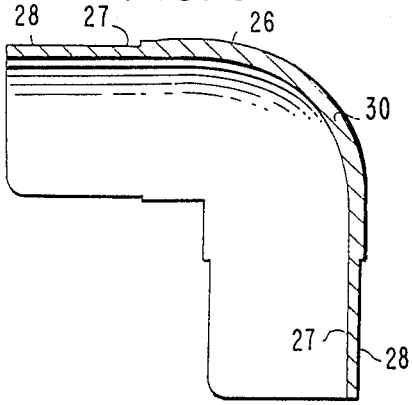
FIG. 6 illustrates a section taken along lines AA of FIG. 4.

As illustrated in FIG. 1 and FIGS. 3–6, the present invention also preferably includes an elbow member 26 which is preferably constructed of high impact styrene or other materials such as brass, wood and the like. It includes a 90° bent portion 30 from which extend two male couplings 27. The male couplings 27 preferably include a tapered section 28, which for example may be formed by putting a chamfer 28 on the male coupling 27 as illustrated in FIGS. 4 and 6. One of the male couplings 27*a* is slidably received by one end of the fascia 23, the outer shape of the male coupling 27 conforming to the inside configuration of the fascia 23. The male coupling 27 is inserted into the spaces 29 formed by the semicircular section 24 and the clip portions 25 of the fascia 23.

The other male coupling 27*b* is adapted to be inserted in a side fascia 31 as illustrated in FIG. 1. The side fascia 31 has clip portions 25 similar to the fascia 23, and similarly has spaces 29 into which the other male coupling 27*b* is inserted creating a tight fit.

As illustrated, the male couplings 27 may be supplied with peel ribs 32, which assist in creating the tight fit between the male couplings 27 and the fascia 23 and side fascia 31. In addition to coupling the fascia 23 to the side fascia 31, the elbow member 26 provides a smooth, finished appearance to the corner of the curtain rod assembly. Typically, there are two such elbow members 26, one at either end of the fascia 23, connecting two side fascias 31 to the fascia 23.

The side fascias 23 in turn, are connected to the track 10 by a connecting means 33, such as a universal return plate. The return plate 33 has a face plate 34 to which is attached an attachment flange 35. The attachment flange 35 illustrated in FIG. 1 includes a hole 36 for receiving a fastener, such as a screw 37. The return plate 33 is attached to the track 10 by placing the attachment flange 35 inside the space 38 of the slotted section 11 and inserting the screw 37 through the hole 36. The head of the screw 36 is then tightened against the rear and front lips 19 and 20.

Figure 7:
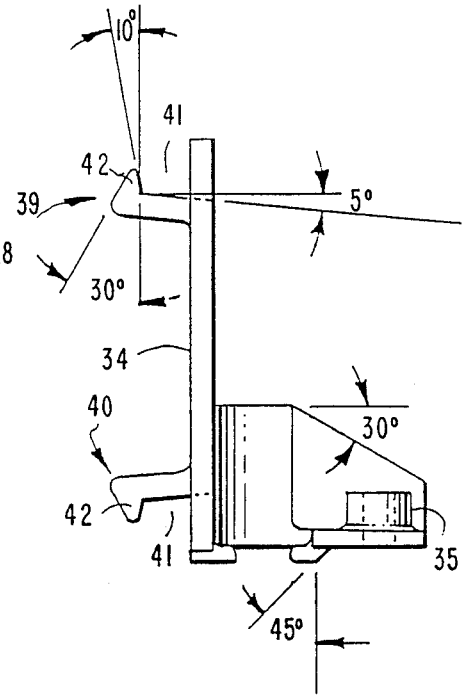
FIG. 7 illustrates a side view of a return means for use with a preferred embodiment of the present invention.
Figure 8:
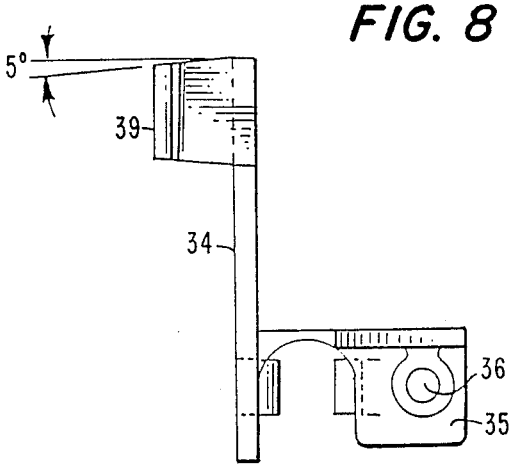
FIG. 8 illustrates a top view of a return means illustrated in FIG. 7.

The return plate 33 also includes an upper flange 39 and a lower flange 40 extending outwardly from the faceplate 34. Like the upper and lower flanges 14 and 15 of the track 10, the upper and lower flanges 39 and 40 of the return plate 33 have a grooved portion 41 adjacent the face plate 34 and a curbed portion 42 adjacent the grooved portion 41. The upper and lower flanges 39 and 40 are preferably splayed at a slight outward angle with respect to each other. An angle of about 5° with respect to a line normal to the face plate 34 as illustrated in FIG. 7 has proven satisfactory.

The clip portions 25*c* and 25*d* of the side fascia 31 are clipped respectively to upper and lower flanges 39 and 40 of the return plate 33, in much the same manner as the clip portions 25*a* and 25*b* of the fascia 23 are slidably received by or clipped to the upper and lower flanges 14 and 15 of the track 10. The clip portions 25 of the side fascia 31 are slidably received by the grooved portions 41, and the side fascia is retained in slidable engagement with the return plate 33 by the curbed portions 42.

The side fascia 31 is preferably constructed of the same material as the fascia 23. The side fascia is thus a decorative facing which serves to cover the less aesthetically pleasing functional components of the curtain rod assembly. In addition, the side fascia 31 serves, at least in part, as a means of attaching the curtain rod assembly to a wall. In this regard, as illustrated in FIG. 1, the side fascia 31 may be inserted into a wall socket 43. The wall socket 43 has means 44 for fastening the wall socket 43 to a wall, such as a flange with screw holes therein. Additionally, the wall socket 43 has a receptacle 45 sized and shaped to permit slidable insertion of the side fascia 31 therein. Preferably, the side fascia 31 is sized to fit snugly into the receptacle 45, obviating the need for other fasteners or adhesive means, which of course, could be employed.

For example, as illustrated in FIGS. 10–12, the wall socket 43 may include one or more posts 46 positioned around the perimeter of the receptacle 45, spaced from the receptacle wall 47 to enable the side fascia to be held securely between the posts 46 and the receptacle wall 47. In addition to or in place of wall sockets, the curtain assembly may be attached to a wall with conventional attachment means not shown.

The wall socket is preferably manufactured of high impact styrene, which has been coated with a coating matching that of the fascia 23 and side fascias 31.

The return plate 33 is preferably positioned flush against the end 48 of the track 10, such that the face plate 34 abuts the end 48 of the track 10.

Figure 13:
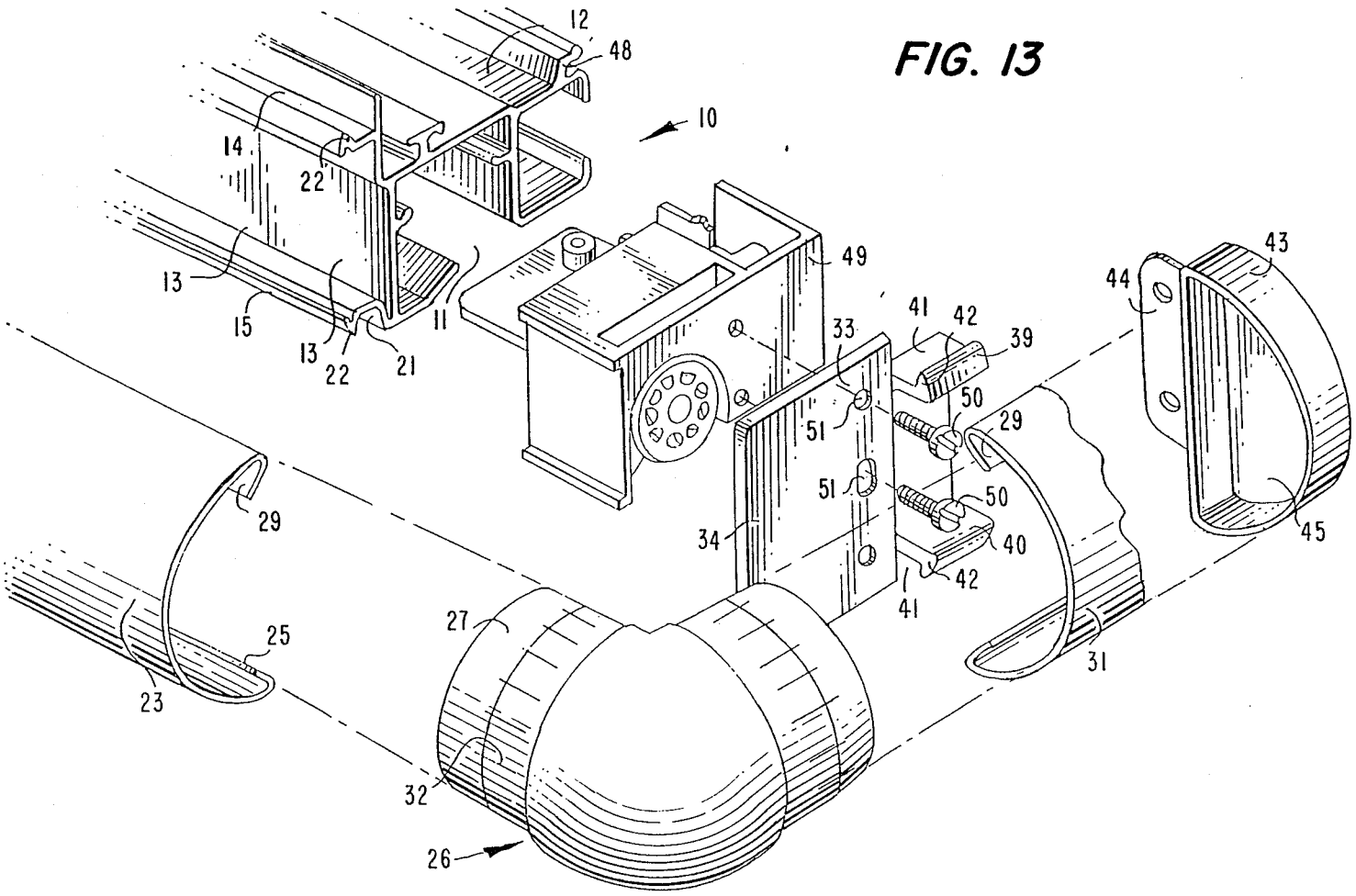
FIG. 13 illustrates a isometric exploded view of another preferred embodiment of the present invention.

An alternative preferred embodiment of the present invention is illustrated in FIG. 13. In this embodiment, the track 10 is adapted for use with vertical blinds. In the FIG. 13 embodiment, a vertical blind rotating mechanism 49 is positioned at the end 43 of the track 10 and secured thereto. A modified return plate 33 is then attached to the rotating mechanism 49, for example, with screws 50, which are passed through holes 51 in the face 34 of the return plate 33.

Preferably, the assembly is constructed such that the elbow 26 is a right angle bend imparting a right angle relationship between the fascia and side fascias. Of course, other angles are possible.

What is claimed is:

1. A curtain rod assembly comprising:

a. A track having two ends and means for supporting a curtain on said track, fascia fastener means attached to said track;

b. a fascia member having a first and second end, said fascia member being releasably received by said fascia fastener means, said fascia member having clip means cooperating with said fascia fastening means for enabling said fascia member to be secured to said track;

c. an elbow having first and second couplings, said first coupling being slidably received by said first end of said fascia member;

d. a side fascia member having a first and second end, said elbow second coupling being slidably received by said first end of said side fascia member;

e. a support member fastened to one said end of said track, said support member having side fascia fastener means attached thereto, said side fascia member being slidably received by said side fascia fastener means, said side fascia member having clip means cooperating with said side fascia fastening means for enabling said side fascia member to be secured to said support member.

2. The assembly of claim 1 further including a wall socket adapted to be fastened to a wall, said wall socket having a receptacle, into which receptacle said second end of said side fascia member is slidably received.

3. The assembly of claim 2 wherein said wall socket further includes a receptacle wall, at least one rigid post, said post being spaced from said receptacle wall, and said second end of said side fascia being held securely between said post and said receptacle wall.

4. The assembly of claim 1, wherein said fascia fastener means comprises an upper flange and a lower flange extending outwardly from said track, said upper and lower flanges each having a grooved portion adjacent said track and a curved portion adjacent said grooved portion.

5. The assembly of claim 4 wherein said fascia member has an external wall and said fascia member clip means includes an upper and lower clip portion attached to said external wall at an acute angle thereto, thereby creating a space between said external wall and each said clip portion, said upper clip portion being slidably received by said grooved portion of said upper flange, and said lower clip portion being slidably received by said grooved portion of said lower flange.

6. The assembly of claim 5 wherein said elbow first coupling is received within the space created by said external wall and each said clip.

7. The assembly of claim 6 wherein said support member is a return plate, said return plate including a face plate, and said side fascia fastener means comprises an upper and lower flange extending from said face plate, said upper, and lower flange each having a grooved portion adjacent said face plate and a curved portion adjacent said grooved portion.

8. The assembly of claim 7 wherein said side fascia member has an external wall and said side fascia member clip means includes an upper and lower clip portion attached to said external wall at an acute angle thereto, thereby creating a space between said external wall and each said clip portion, said upper clip portion of said side fascia member being slidably received by said grooved portion of said upper flange of said return plate, and said lower clip portion being slidably received by said grooved portion of said lower flange of said return plate.

9. The assembly of claim 1 wherein said assembly is adapted for use with hand traverse curtains.

10. The assembly of claim 1 wherein said assembly as adapted for use with vertical blinds.

11. The assembly of claim 1 wherein said elbow first and second couplings include a tapered portion for permitting movement of said elbow slidably with respect to said fascia member and said side fascia member.

12. The assembly of claim 1 wherein a second return plate is fastened to the other end of said track, said second return plate having a second side fascia member slidably fastened thereto, said fascia member having a second elbow slidably received by said second end of said fascia member, said second elbow being slidably received by said second side fascia member.

13. A curtain rod assembly comprising:

(a) a track having two ends and means for supporting a curtain thereon;

(b) a front fascia member having a first end and a second end for covering said track;

(c) means for securing said front fascia member to said track;

(d) a return plate support member for attachment to said track from at least one end thereof;

(e) a side fascia member with a first end and a second end and means for attaching said side fascia member to said support member;

(f) an elbow, said elbow having a first and second end for engaging respectively a first end of said front fascia member and the first end of said side fascia member; and (g) said elbow having exterior surfaces coplanar with said front fascia and said side fascia members wherein said elbow, said fascia and said side fascia include a continuously curved surface of constant cross-section throughout the combined length of said fascia and said elbow.

14. A curtain rod assembly comprising:

(a) a track having two ends, and means for supporting a curtain thereon;

(b) a front fascia having a first and second end and being coextensive with said track, said track having a flange, said front fascia defining a clip cooperating with said flange to secure said fascia to said track;

(c) a side fascia having a first end and a second end;

(d) a return plate for engagement with said track from at least one end thereof;

(e) said return plate having first and second plate flanges and said side fascia defining a clip for engaging said plate flanges to secure said side fascia thereto;

(f) said front fascia having an external wall which when secured to said track creates a front space therebetween;

(g) said side fascia having an external wall which when secured to said return plate creates a side space therebetween;

(h) an elbow having a first coupling and a second coupling, including a tapered portion for slidable engagement into the space created by said front fascia and said track and said side fascia and said return plate;

(i) said elbow having exterior surfaces coplanar with said front fascia and said side fascia wherein said elbow, said front fascia and said side fascia include a continuously curved surface of constant cross-section throughout the combined length of said fascia and said elbow; and (j) a wall socket with means for attaching said socket to a wall, said wall socket having a receptacle including a wall and a post spaced from said wall, said second end of said side fascia being securely held between said post and said wall.

15. A curtain rod assembly comprising:

a. a track having two ends and means for supporting a curtain on said track, fascia fastener means attached on said track;

b. a fascia member having a first and second end, said fascia member being slidably received by said fascia fastener means, said fascia member having clip means cooperating with said fascia fastening means for enabling said fascia member to be secured to said track; and c. a support member fastened top one end of said track, said support member having side fascia fastener means attached thereto, a side fascia member being slidably received by said side fascia fastener means, said side fascia member having clip means cooperating with said side fascia fastening means for enabling said side fascia member to be secured to said support member;

wherein said fascia fastener means comprises an upper flange and a lower flange extending outwardly from said track, said upper and lower flanges each having a grooved portion adjacent said track and a curved portion adjacent said grooved portion;

wherein said fascia member has an external wall and said fascia member clip means includes an upper and lower clip portion attached to said external wall at an acute angle thereto, thereby creating a space between said external wall and each said clip portion, said upper clip portion being slidably received by said grooved portion of said upper flange, and said lower clip portion being slidably received by said grooved portion of said lower flange; and wherein said support member is a return plate.

16. The assembly of claim 23 wherein said assembly is adapted for use with vertical blinds.

* * * * *